US007013686B1

(12) United States Patent
Chen

(10) Patent No.: US 7,013,686 B1
(45) Date of Patent: Mar. 21, 2006

(54) MOTORBIKE LOCK

(76) Inventor: Meng-Fu Chen, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 10/997,927

(22) Filed: Nov. 29, 2004

(51) Int. Cl.
*E05B 67/10* (2006.01)

(52) U.S. Cl. ..... 70/43; 70/39; 70/233

(58) Field of Classification Search ..... 70/35, 70/39, 38 R, 38 A, 38 B, 38 C, 41–44, 233–236
See application file for complete search history.

(56) References Cited

U.S. PATENT DOCUMENTS 4,545,224 A * 10/1985 Zane ..... 70/39
4,987,753 A * 1/1991 Kuo ..... 70/39
5,199,282 A * 4/1993 Wang ..... 70/39
5,253,496 A * 10/1993 Wang ..... 70/38 R
5,331,830 A * 7/1994 Su ..... 70/39
5,410,895 A * 5/1995 Hsu et al. ..... 70/39
5,490,402 A * 2/1996 Shieh ..... 70/39
5,511,400 A * 4/1996 Ma ..... 70/39
5,678,431 A * 10/1997 Yan ..... 70/39
5,720,191 A * 2/1998 Tsung-Chuan et al. ..... 70/39
5,787,736 A * 8/1998 Ling ..... 70/26
6,055,833 A * 5/2000 Ding-Chiang ..... 70/39

* cited by examiner

*Primary Examiner*—Brian E. Glessner
*Assistant Examiner*—Christopher Boswell

(57) ABSTRACT

A motorbike lock includes a cylindrical body, two limit discs, two springs, a retainer, a core, a press button, a sleeve, a cap and a shackle. When the pressure button is pushed inward, the retainer is moved to force the core push the limit discs to compress the spring, with the stopper of one shackle end stopped in the cylindrical body. Then the pin in the retainer inserts in an insert hole of the cylindrical body to secure the retainer immovable, finishing locking of the lock. When the key is inserted through the press button and in the core and rotated, the pin is pressed inward to separate from the insert hole of the cylindrical body, with the retainer no longer kept immovable by the pin, letting the spring recover its elasticity to push the retainer back, with the stopper of the shackle end becoming free and the lock unlocked.

1 Claim, 7 Drawing Sheets

MOTORBIKE LOCK

BACKGROUND OF THE INVENTION

1. Field of the Invention

This invention relates to a motorbike lock, particularly to one having a cylindrical body, two limit discs, two springs, a retainer, a pin, a core, a press button, a sleeve, a cap and a shackle. When the press button fitted in the sleeve is pressed inward to move the core and the retainer to shift inward in a chamber of the cylindrical body, one of the two limit disc is moved to compress the spring in the chamber so that the end of the shackle inserted in a shackle hole of the cylindrical body is stopped by the sidewall of a slot of the retainer and become immovable to let the shackle locked in the condition, and the pin in the retainer inserts in the insert hole of the cylindrical body, with the retainer secured immovable. Thus the lock is locked. In unlocking, a key is inserted through the press button and in the core, and then rotated to rotate the core, with the pin compressed and separating from the insert hole of the cylindrical body so that the retainer may not be restricted by the pin and return to the original position to let the lock unlocked, with the stopper of the shackle on longer stopped by the sidewall of the slot of the retainer.

2. Description of the Prior Art

A conventional motorbike lock shown in FIG. 1 includes a cylindrical body 10, a hollow chamber 100 formed in the cylindrical body 10, a core base 11 placed in a front end of the chamber 100, pin holes 101 and 110 formed respectively in the cylinder body 10, and the core base 11 for pins 13 to insert to combine the core base 11 with the cylindrical body 10. In locking, a first end 120 of a U-shaped shackle 12 is first inserted slantingly in a lock hole 102 of the cylindrical body 10, with a groove 121 of the first end 120 to engage with a stopper 103 in one end of the chamber 100. Then the shackle 12 is pushed to an upright position, letting the second end 122 of the shackle 12 insert in the lock hole 104 of the cylindrical body 10 and locked by the core base 11. Thus the shackle 12 is kept locked, impossible to be pulled out of the cylindrical body 10.

However, the conventional motorbike lock has its first end 120 of the shackle 12 kept immovable with the stopper 103 of the cylindrical body 10, only with one side of the first end 120 contacting with the stopper 103, not locked tightly enough. So a thief may be able to tamper with the shackle 12 or the cylindrical body 10 by striking strongly and break the core base 11 for unlocking, then the lock totally loses its function.

SUMMARY OF THE INVENTION

The motorbike lock according to the invention includes a cylindrical body, two limit discs, two springs, a retainer, a pin, a core, a press button, a sleeve, a cap and a shackle. When the press button fitted in the sleeve is pressed inward to move the core and the retainer to shift in a chamber of the cylinder body, one of the two limit disc is moved to compress the spring in the chamber so that the end of the shackle inserted in a shackle hole is stopped by the sidewall of the slot of the retainer and become immovable to let the shackle locked in the condition, and the pin in the retainer inserts in the insert hole of the cylindrical body, with the retainer secured immovable. Thus the lock is locked. In unlocking, a key is inserted through the press button and in the core, and then rotated to rotate the core, with the pin compressed and separating from the insert hole of the cylinder so that the retainer may not be restricted by the pin to return to the original position to let the lock unlocked, with the stopper of the shackle on longer stopped by the sidewall of the slot of the retainer.

The feature of the invention is the core is hidden in the cylindrical body, preventing the lock from opened with a master key by a thief, having an extraordinary anti-theft function.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
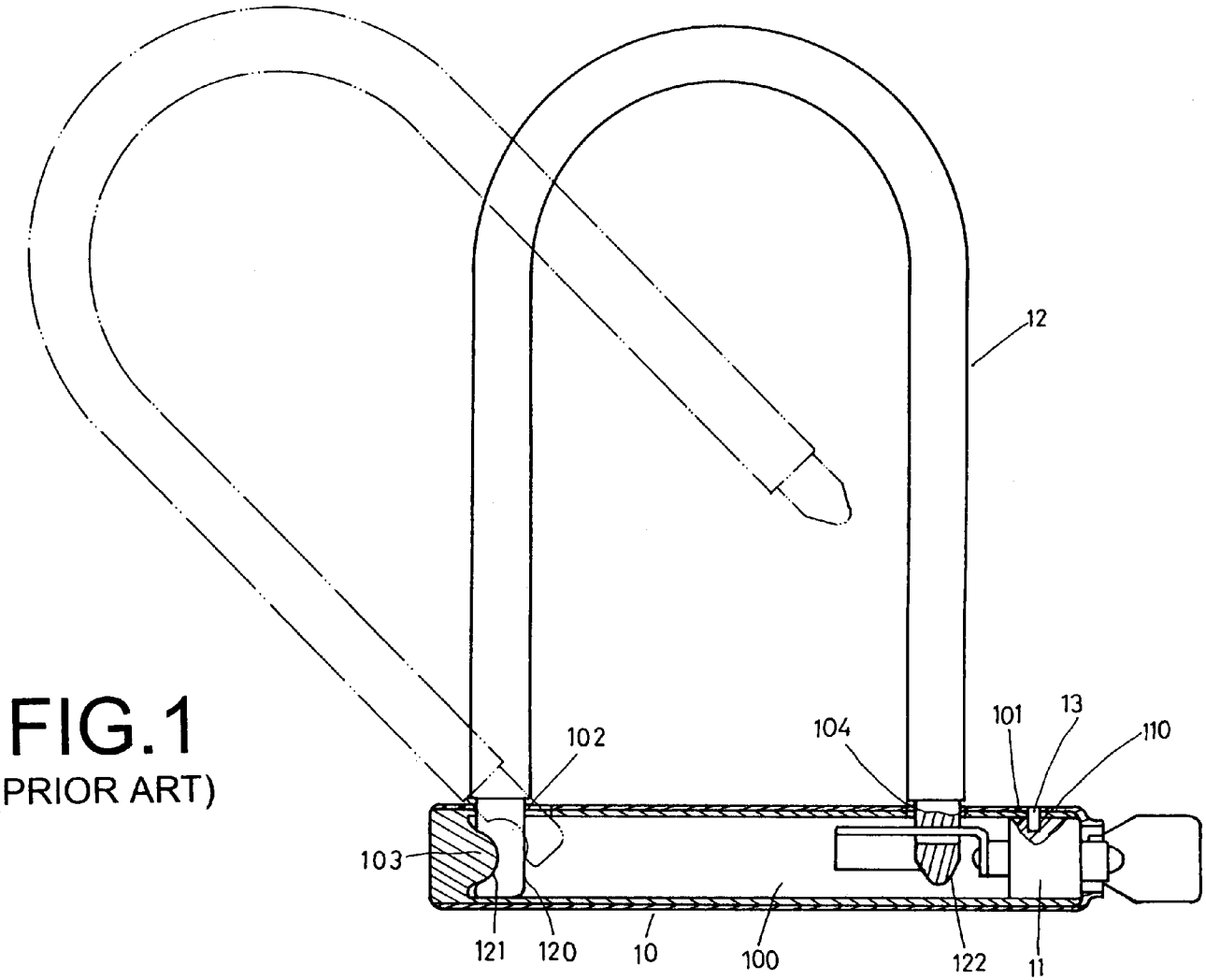
FIG.1 (PRIOR ART)
FIG. 1 is a side cross-sectional view of a conventional motorbike lock.
Figure 2:
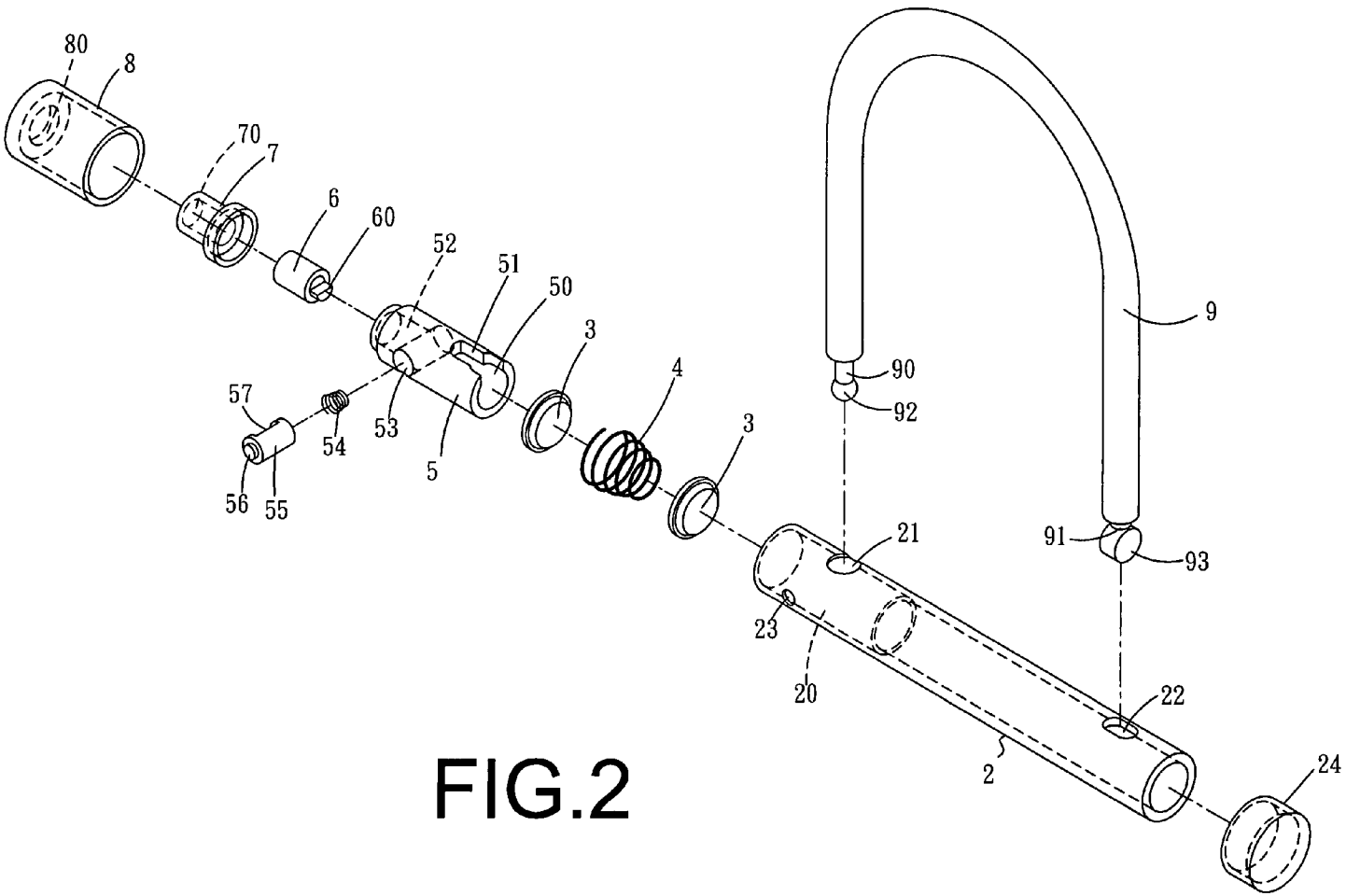
FIG. 2 is an exploded perspective view of a motorbike lock in the present invention.
Figure 3:
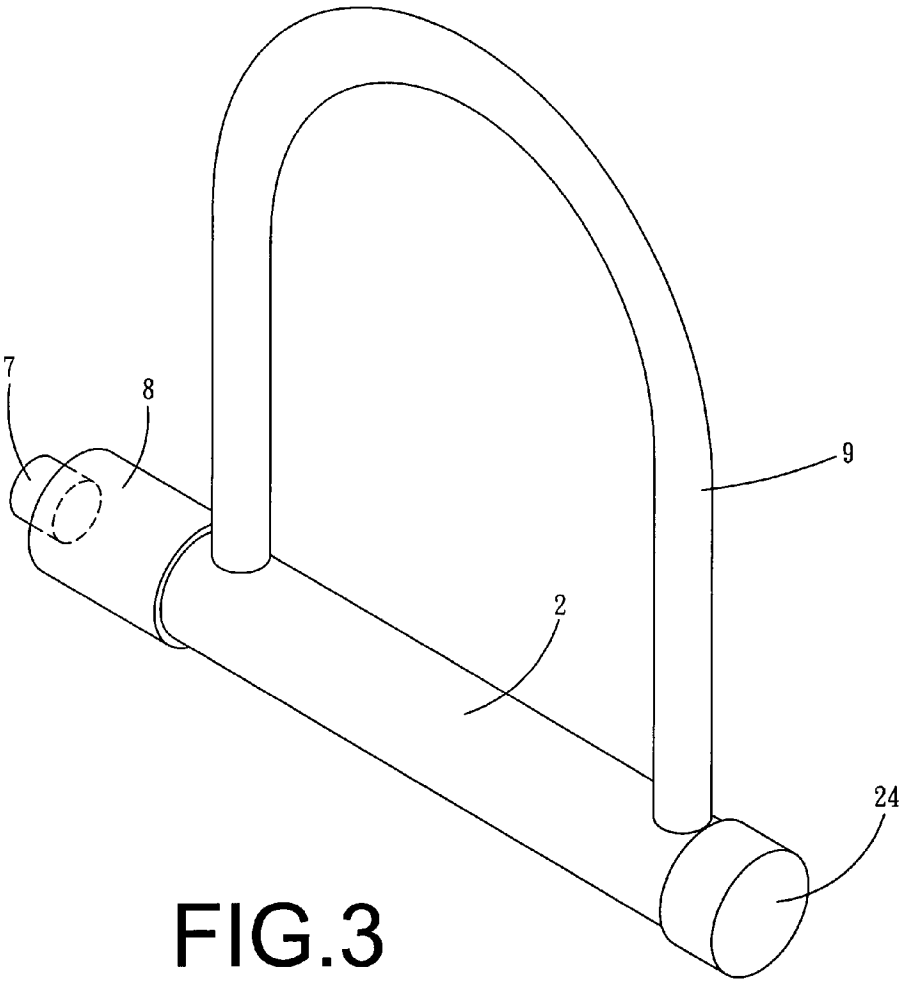
FIG. 3 is a perspective view of the motorbike lock in the present invention.

A preferred embodiment of a motorbike lock in the present invention, as shown in FIG. 2, includes a cylindrical body 2, a cap 24, two limit discs 3, a spring 4, a retainer 5, a core 6, a press button 7, a sleeve 8 and a shackle 9 as main components.

The cylindrical body 2 has a center chamber 20 in a right side portion, a first hole 21 in a left end portion and a second hole 22 in a right end portion, and an insert hole 23 near the left end.

The cap 24 closes an opening of the right end of the cylindrical body 10.

The two limit discs 3 are positioned spaced apart in the chamber 20.

The spring 4 is positioned between the two limit discs 3.

The retainer 5 is movably positioned in the chamber 20 of the cylindrical body 10, having an opening 50 in a right end, a slot 51 extending inward from the opening 50, a small cell 52 in a left end portion, and a sidewise hole 53 communicating with the small cell 52, a spring 54 and a pin 55 fitted in the sidewise hole 53. The pin 55 has a projection 56 at the outer end and a groove 57 in a sidewall.

The core 6 is positioned in the small cell 52 of the pin 55, having a rotary member 60.

The press button 7 is positioned in an outer end portion of the retainer 5, having a hole 70 in the center.

The sleeve 8 is positioned around the left end portion of the cylindrical body 2, having a center hole 80.

The shackle 9 is U-shaped, having two small ends 90 and 91 looking like rods, and a stopper 92 and 93 respectively extending out from the two small ends 90 and 91.

In assembling, referring to FIGS. 2, 3, 4 and 6, firstly, one of the limit discs 3 is inserted in the chamber 20 of the cylindrical body 2, with its circumference contacting the inner wall of the chamber 20, and then the spring 4 is inserted in the chamber 20. Then the other limit disc 3 is inserted in the chamber 20 to contact with the spring 4. Next, the other spring 54 and the pin 55 are placed in the sidewise hole 53 of the retainer 5, and then the core 6 is pushed in the small cell 52 of the retainer 5, with the rotary member 60 fitting in the groove 57 of the pin 55, with the press button 7 placed to contact the left end of the retainer 5. Then the combined unit of the retainer 5 with the press button 7 is placed in the chamber 20 of the cylindrical body 2, letting the projection 56 fitting in the insert hole 23 of the cylindrical body 2. Then the sleeve 8 and the cap 24 are pressingly combined with the two ends of the cylindrical body 2, and the stoppers 92 and 93 of the two ends of the shackle 9 are respectively inserted in the two holes 21 and 23, finishing the assembly of this motorbike lock.

Figure 4:
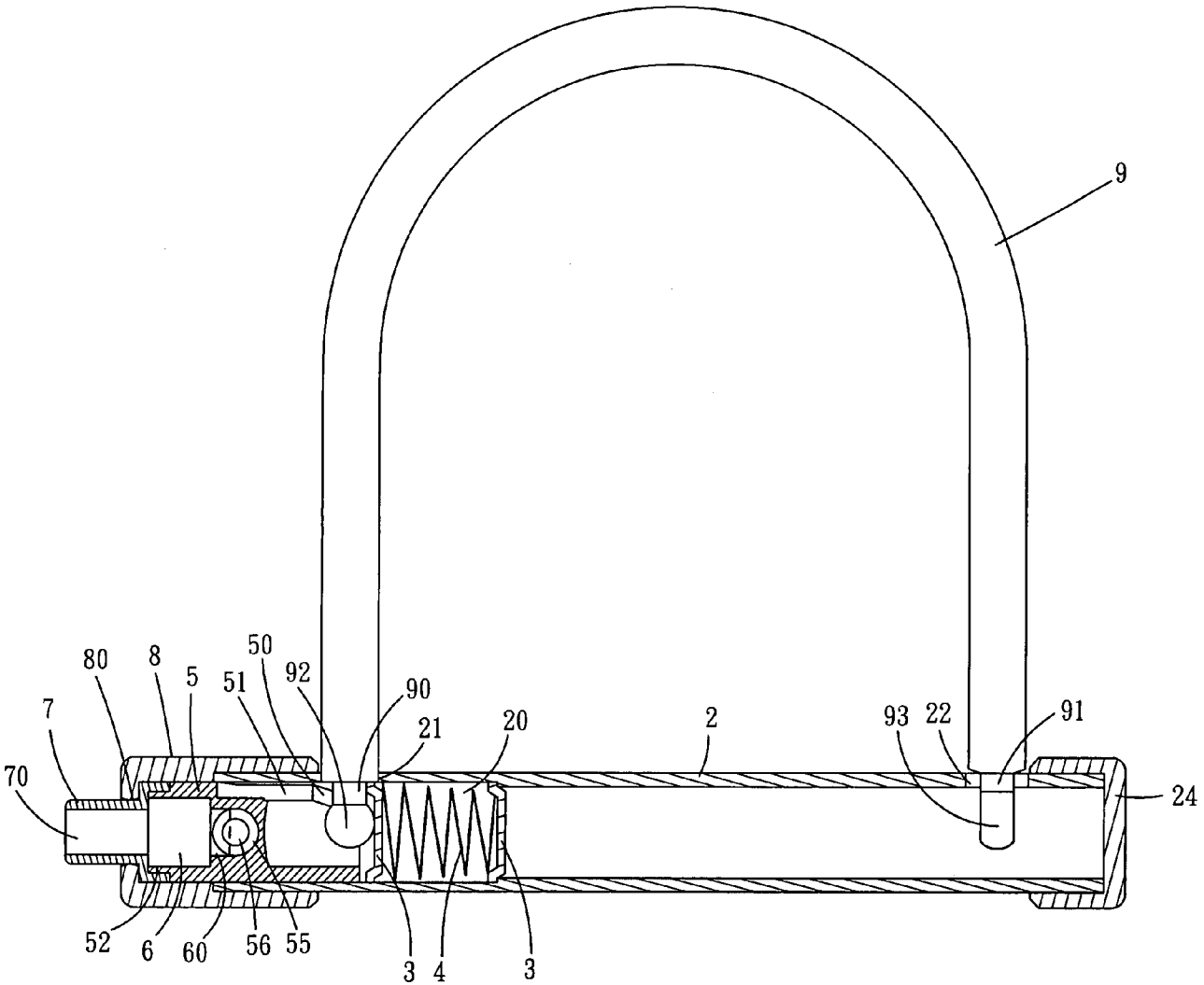
FIG. 4 is a side cross-sectional view of the motorbike lock in an unlocked condition in the present invention.
Figure 5:
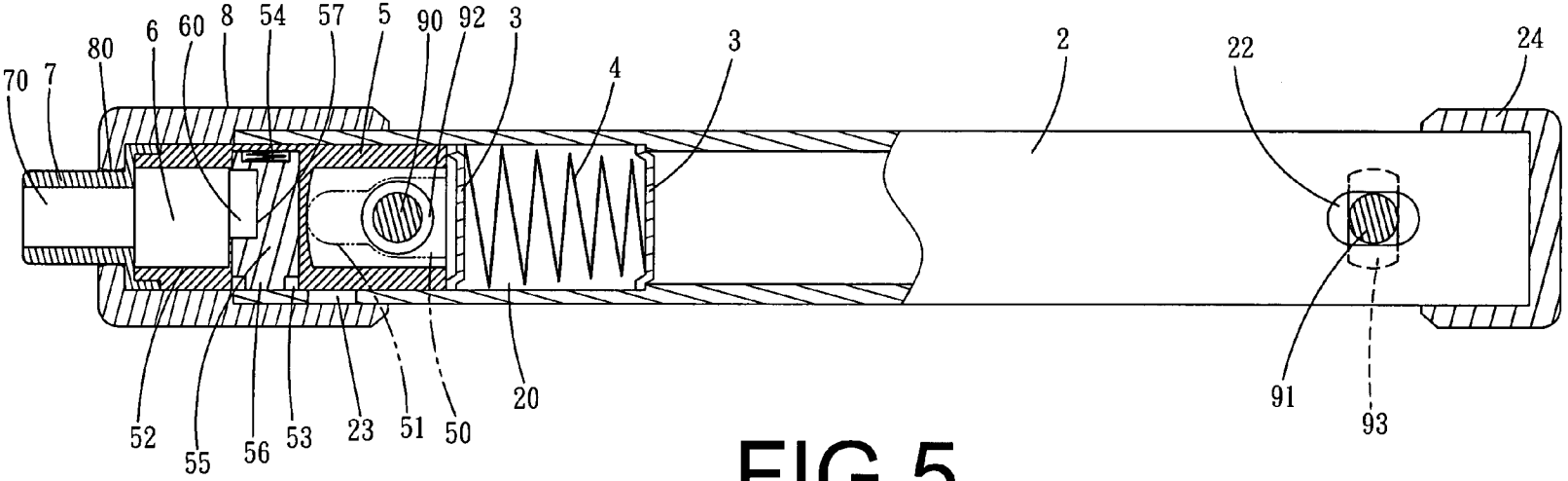
FIG. 5 is an upper view of the motorbike lock in the unlocked condition in the present invention.
Figure 6:
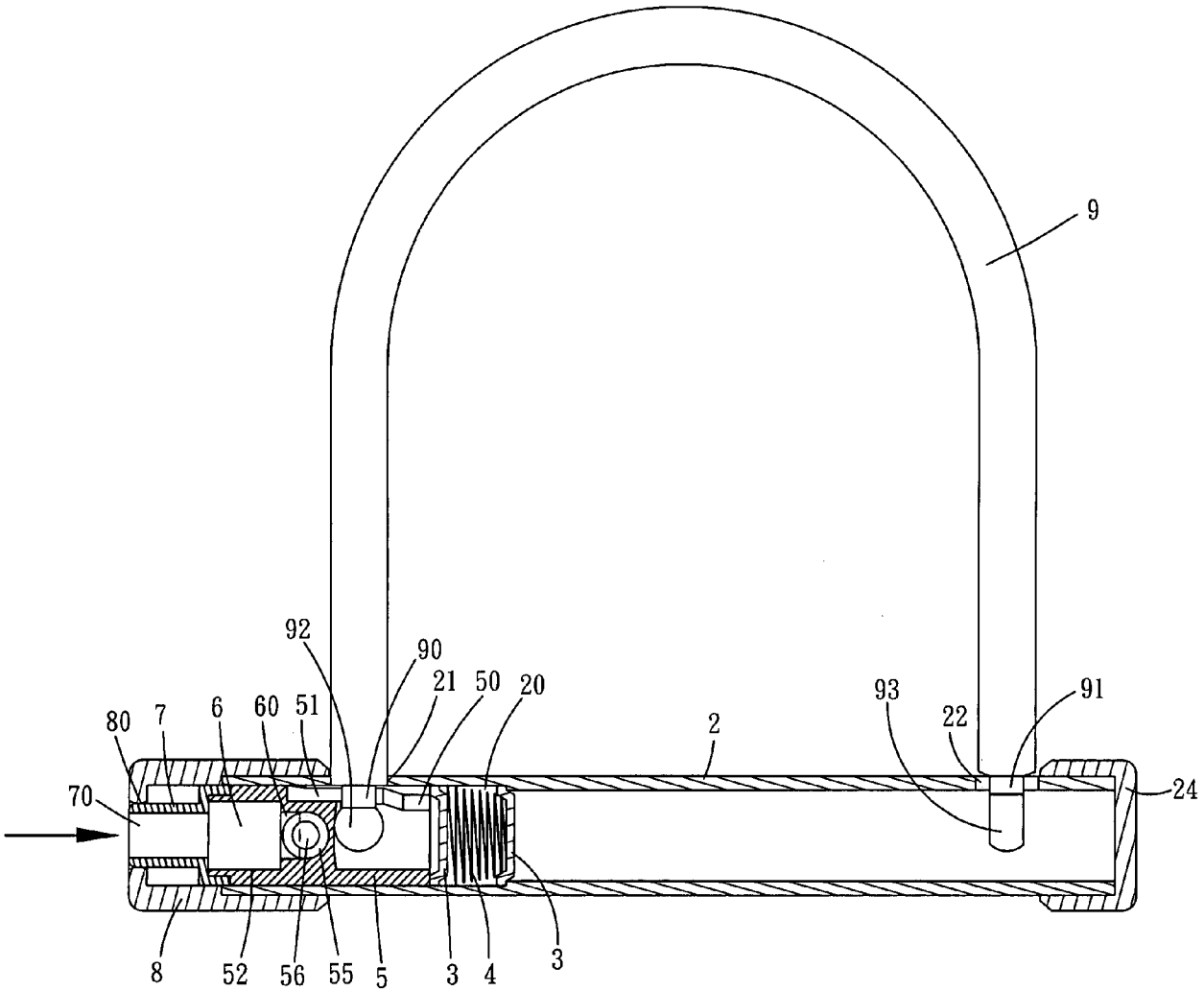
FIG. 6 is a side cross-sectional view of the motorbike lock in a locked condition in the present invention; and, FIG. 7 is an upper view of the motorbike in the locked condition in the present invention.
Figure 7:
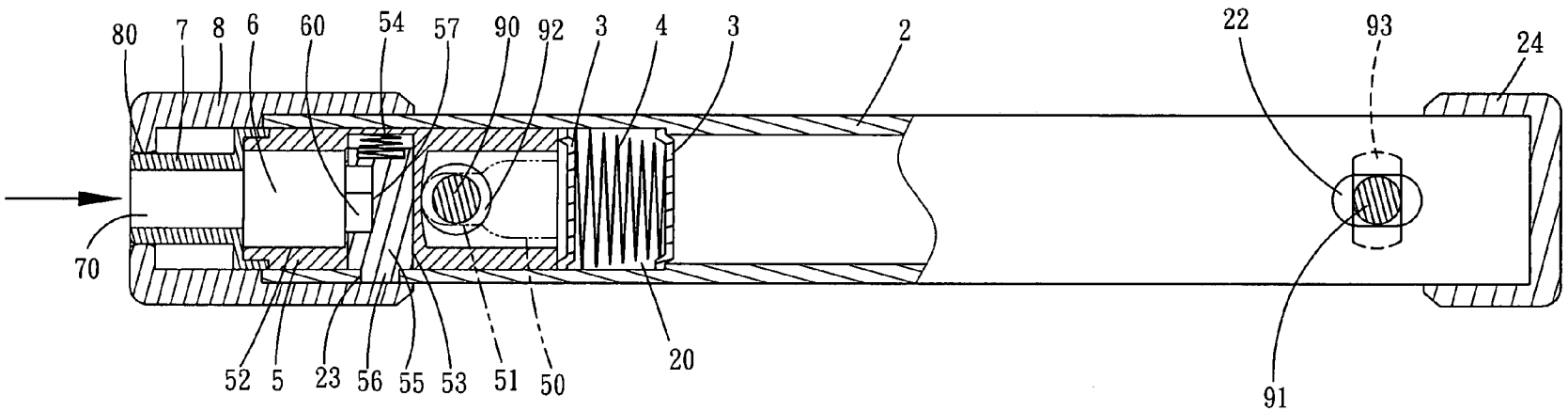

In locking, referring to FIGS. 4, 5, 6 and 7, at first, the shackle 9 is positioned around a wheel of a motorbike (not shown), then the cylindrical body 2 is combined with the shackle 9 by aligning the stopper 93 of the shackle 9 to the hole 22 of the cylindrical body 2, and then inserting the stopper 93 in the hole 22. After that, the cylindrical body 2 is rotated for 90 degrees, so the stopper 93 becomes vertical in the hole 22, impossible to slip out of the hole 22, as shown in FIG. 5. Next, the other stopper 92 of the shackle 9 is inserted in the hole 21 of the cylindrical body 2, with the opening 50 of the retainer 5 aligned to the hole 21, and then the press button 7 extending out of the sleeve 8 is pressed in the sleeve 8, and also the retainer 5 is pushed towards the chamber 20, with the retainer 5 pushing one of the limit discs 3, which then pushes the spring 4. When the retainer 5 has its slot 51 shifted to the shackle end 90, the stopper 92 of the shackle end 90 may be stopped by the wall of the slot 51, with the shackle end 90 stopped also and impossible to be pulled out of the cylindrical body 2, as shown in FIG. 5. Meanwhile, the pin 55 in the small cell 53 of the retainer 5 is inserted in the insert hole 23 of the cylindrical body 2 to secure the retainer 5 immovable. That means the motorbike lock is locked on the motorbike wheel, as shown in FIGS. 6 and 7. After locked, the core 6 is hidden in the retainer 5 in the cylindrical body 2, so a thief cannot see the key hole of the core 6, completely impossible to pry open this lock with a master key, Further, the hole 70 of the press button 7 has the size just as large as the key, preventing any other tools from inserted in the core 6 for prying open the lock, so this lock has an extraordinary anti-theft function.

On the contrary, in unlocking, the key is inserted through the hole 70 of the press button 7 and then into the key hole of the core 6, and then rotated to rotate the core 60, which then moves the rotary member 60 to push the pin 55 inward to compress the spring 54, with the projection 56 of the pin 55 separating from the insert hole 23 of the cylindrical body 2. Then the retainer 5 is no longer controlled by the pin 55, elastically pushed back to its original position by the spring 4 in the chamber 20 of the cylindrical body 2. The retainer 5 moves together the press button 7 outward, with the opening 50 of the retainer 5 shifting to the end 90 of the shackle 9, and with the stopper 92 not stopped by the sidewall of the slot 51, as shown in FIG. 5. Then the cylindrical body 2 is rotated for 90 degrees, permitting the stopper 93 of the shackle 9 pulled out of the hole 22 of the cylindrical body 2. So the unlocking this lock is finished, as shown in FIGS. 4 and 5.

The motorbike lock according to the invention has the following advantages, as can be understood from the foresaid description.

1. The locking is carried out by pressing, obtaining the best efficiency for locking the shackle to the cylindrical body.

2. The core is hidden in the cylindrical body, preventing it from unlocked by a master key, possessing the best anti-theft function.

3. Its locking and unlocking are both convenient and quick.

While the preferred embodiment of the invention has been described above, it will be recognized and understood that various modifications may be made therein and the appended claims are intended to cover all such modifications that may fall within the spirit and scope of the invention.

What is claimed is:

1. A motorbike lock comprising:

a cylindrical body having a hollow chamber in one side portion, a first shackle hole and a second shackle hole spaced apart on the same surface, and an insert hole in a wall near one end and communicating with said chamber;

a cap closes an opening of the right end of the cylindrical body;

two limit discs being positioned spaced apart in the chamber;

a first spring positioned in said chamber of said cylindrical body;

a retainer positioned in said chamber of said cylindrical body, having an opening in one end, a slot extending inward from said opening, a small cell formed in the other end, a sidewise hole communicating with said small cell, and a second spring and a pin fitted in said small cell, said pin having a projection and a groove at a side facing toward an opening of the insert hole;

a core positioned in said chamber of said cylindrical body and having a rotary member; the rotary member axially extending from the core and being capable of inserting into the groove of the retainer; the core being positioned at a left side of the pin and the first spring being positioned at the right side of the pin;

a press button positioned in one end of said retainer and having a center hole;

a sleeve fitting around one end of said cylindrical body and having a center hole; and, a shackle of a U shape to be combined with said cylindrical body, having two ends respectively provided with a small rod-shaped end and a stopper respectively extending outward from said small rod;

wherein in assembling, one of the limit discs is inserted in the chamber of the cylindrical body, with its circumference contacting the inner wall of the chamber, and then the first spring is inserted in the chamber; then the other limit disc is inserted in the chamber to contact with the spring; next, the other spring and the pin are placed in the sidewise hole of the retainer, and then the core is pushed in the small cell of the retainer, with the rotary member fitting in the groove of the pin, with the press button placed to contact the left end of the retainer; then the combined unit of the retainer with the press button is placed in the chamber of the cylindrical body, letting the projection fitting in the insert hole of the cylindrical body; then the sleeve and the cap are pressingly combined with the two ends of the cylindrical body, and the stoppers of the two ends of the shackle are respectively inserted in the two holes, finishing the assembly of this motorbike lock.

* * * * *